US006705935B2

(12) United States Patent
Kuramochi et al.

(10) Patent No.: US 6,705,935 B2
(45) Date of Patent: Mar. 16, 2004

(54) ABRASIVE MOLDING AND ABRASIVE DISC PROVIDED WITH SAME

(75) Inventors: Hideto Kuramochi, Yamato (JP); Shuji Takatoh, Sagamihara (JP); Satoshi Kondo, Yokohama (JP); Masayuki Kudo, Machida (JP); Hiroyuki Yokomizo, Yokohama (JP); Mutsumi Asano, Sagamihara (JP)

(73) Assignees: Tosch Corporation, Yamaguchi (JP); Tosoh Quartz Corporation, Yamagata (JP)

( * ) Notice: Subject to any disclaimer, the term of this patent is extended or adjusted under 35 U.S.C. 154(b) by 181 days.

(21) Appl. No.: 09/996,997

(22) Filed: Nov. 30, 2001

(65) Prior Publication Data

US 2002/0110661 A1 Aug. 15, 2002

(30) Foreign Application Priority Data

Nov. 30, 2000 (JP) ..... 2000-369627

(51) Int. Cl.[7] ..... B24B 11/00; B24D 3/00

(52) U.S. Cl. ..... 451/527; 451/546; 451/548; 451/550; 51/307; 51/309

(58) Field of Search ..... 51/307, 308, 309, 51/293; 451/527, 526, 540, 546, 548, 550

(56) References Cited

U.S. PATENT DOCUMENTS

| | | | | | |
|---|---|---|---|---|---|
| 3,925,035 | A | * | 12/1975 | Keat | 51/309 |
| 4,001,981 | A | * | 1/1977 | Wood | 451/548 |
| 5,090,970 | A | * | 2/1992 | Rue et al. | 51/309 |
| 6,328,644 | B1 | * | 12/2001 | Kuramochi et al. | 451/526 |
| 6,375,692 | B1 | * | 4/2002 | Manwiller et al. | 51/302 |

* cited by examiner

*Primary Examiner*—Timothy V. Eley
(74) *Attorney, Agent, or Firm*—Nixon & Vanderhye P.C.

(57) ABSTRACT

An abrasive molding composed of a mass of inorganic particles, said mass having pores intervening among the inorganic particles, which molding has abrasive area to be placed in frictional contact with an article to be abraded, and non-abrasive area on a abrading surface of the abrasive molding. The abrasive area has exposed pores having a diameter of not larger than 1 $\mu$m, the total area of said exposed pores having a diameter of not larger than 1 $\mu$m occupying below 15% of the total area of abrasive area, and the non-abrasive area occupies 20% to 60% of the sum of the abrasive area and the non-abrasive area.

14 Claims, 1 Drawing Sheet

ABRASIVE MOLDING AND ABRASIVE DISC PROVIDED WITH SAME

BACKGROUND OF THE INVENTION (1) Field of the Invention

This invention relates to an abrasive molding and an abrasive disc provided with at least one abrasive molding, which are used in a process for abrading, especially abrading, substrate materials such as silicon wafer, an oxide monocrystal substrate, a compound semiconductor substrate, glass substrates, a silica glass substrate and a ceramic substrate, and optical materials.

(2) Description of the Related Art

With the advance of industries including an optical industry and an electronic industry, a higher precision is required for processing material for a magnetic disc, a semiconductor substrate, an optical material and other substrate materials. Thus, there is an increasing demand for obtaining higher smoothness and flatness by abrading the material surface in a lapping step as well as in a polishing step.

In a lapping step, i.e., abrading step before a finishing step, abrading is carried out while an abrading liquid containing a loose abrasive grain is continuously supplied onto the material surface by using a lapping disc. The abrasive grain is composed of, for example, aluminum oxide, iron oxide, chromium oxide, zirconium oxide, silicon carbide or diamond. As the lapping disc, a disc made of graphitized cast iron is widely used.

The conventional lapping step using a loose abrasive grain has a problem such that the loose abrasive grain tends to stick the material surface and thus forming pits thereon. Further, if a loose abrasive grain with a large particle size is used for enhancing the productivity, the abraded surface has a large roughness.

To solve the above-mentioned problems, a proposal has been made in Japanese Unexamined Patent Publication (hereinafter abbreviated to "JP-A") No. 2000-42903 wherein lapping is carried out while an abrading liquid containing a loose abrading grain is continuously is supplied in two stages wherein two kinds of loose abrasive grains having different small particle sizes are separately used. However, the use of two different loose abrasive grains in a single abrading apparatus is troublesome in control of the apparatus. If two abrading apparatuses are used for the two different loose abrading grains, it is also troublesome to transfer the material to be abraded from one apparatus to the other apparatus.

A graphitized cast iron disc has a high hardness and therefore is widely used for lapping. This disc has a problem such that the lapping is difficult to carry out under stable conditions. To solve this problem, an improvement is proposed in JP-A 2000-52238 wherein the size of graphite particles distributed in the cast iron and the density thereof are controlled. In view of complexity an difficulty for controlling the apparatus and process, it is eagerly desired to provide an abrading molding exhibiting a good abrading performance and capable of being used under stable conditions.

A disc made of a high-purity aluminum sintered body and having a flat and smooth surface is proposed in JP-A S52-90900. According to this patent, it is said that an abrading disc composed of an sintered aluminum body having a purity of at least 99% and having a smooth surface with roughness of not larger than 6S is provided. This abrading disc has improved acid resistance, alkali resistance and corrosion resistance as compared with cast iron abrading disc. Further, it is taught in JP-A H11-239962 that a lapping disk is preferably made of a high-hardness material, and graphitized cast iron, ceramic materials and natural stone are mentioned. It is further taught that ceramic materials and natural stone are especially preferable because of reduced elongation, reduced thermal expansion coefficient, and good acid resistance against an acidic abrading liquid as compared with graphitized cast iron. However, this patent publication is silent on microstructure of ceramic materials and natural stone, and specific lapping performance of these materials.

SUMMARY OF THE INVENTION

In view of the foregoing, an object of the present invention is to provide an abrasive molding which is suitable for abrading, especially lapping, substrate materials such as a semiconductor substrate, an oxide monocrystal substrate, glass substrates, a silica glass substrate and a ceramic substrate, and optical materials, and by which a material surface having a high surface precision can be obtained at a high abrading rate and, when a loose abrading grain is used continuously for a long period, a high rate abrading can be stably conduced.

Another object of the present invention is to provide an abrasive disc comprising one or more abrasive moldings having the above-mentioned benefits, which are fixed to a supporting auxiliary.

Thus, in accordance with the present invention, there is provided an abrasive molding composed of a mass of inorganic particles, said mass having pores intervening among the inorganic particles, which molding has abrasive area to be placed in frictional contact with an article to be abraded, and non-abrasive area on a abrading surface of the abrasive molding; said abrasive area having exposed pores having a diameter of not larger than 1 $\mu$m, the total area of said exposed pores having a diameter of not larger than 1 $\mu$m occupying below 15% of the total area of abrasive area, and the non-abrasive area occupying 20% to 60% of the sum of the abrasive area and the non-abrasive area.

The abrasive molding is preferably made substantially from a powdery inorganic material having a hardness of at least 800 kg/mm$^2$. The inorganic particles preferably consist essentially of alumina particles and stabilizer-containing zirconia particles, wherein at least 60% of the alumina particles have a diameter of not larger than 5 $\mu$m and at least 60% of the stabilizer-containing zirconia particles have a diameter of not larger than 5 $\mu$m, and the total area (X) of the alumina particles exposed on the abrading surface of the abrasive molding and the total area (Y) of the stabilizer-containing zirconia particles exposed on the abrading surface thereof satisfy the formula:

$$0.25 \leqq X/(X+Y) \leqq 0.95.$$

Preferably, at least 20% of the pores exposed in the non-abrasive area has a diameter of at least 10 $\mu$m.

The stabilizer-containing zirconia particles has a monoclinic crystal percentage of not larger than 5% and contains yttria as a stabilizer in an amount of 3% to 8% by weight based on the weight of the stabilizer-containing zirconia particles.

In accordance with the present invention, there is further provided an abrasive disc comprising at least one abrasive molding and a supporting auxiliary, said abrasive molding being fixed to the supporting auxiliary.

DESCRIPTION OF THE PREFERRED EMBODIMENTS

Characteristics of Abrasive Molding

An abrasive molding of the present invention is composed of a mass of inorganic particles, said mass having pores intervening among the inorganic particles. The abrasive molding has abrasive area to be placed in frictional contact with an article to be abraded, and non-abrasive area on a abrading surface of the abrasive molding. The abrasive area has exposed pores having a diameter of not larger than 1 μm, and the exposed pores having a diameter of not larger than 1 μm occupy below 15% of the total area of abrasive area. The non-abrasive area occupies 20% to 60% of the sum of the abrasive area and the non-abrasive area. Preferably, at least 60% of the inorganic particles exposed in the abrasive area have a diameter of not larger than 1 μm.

Figure 1:
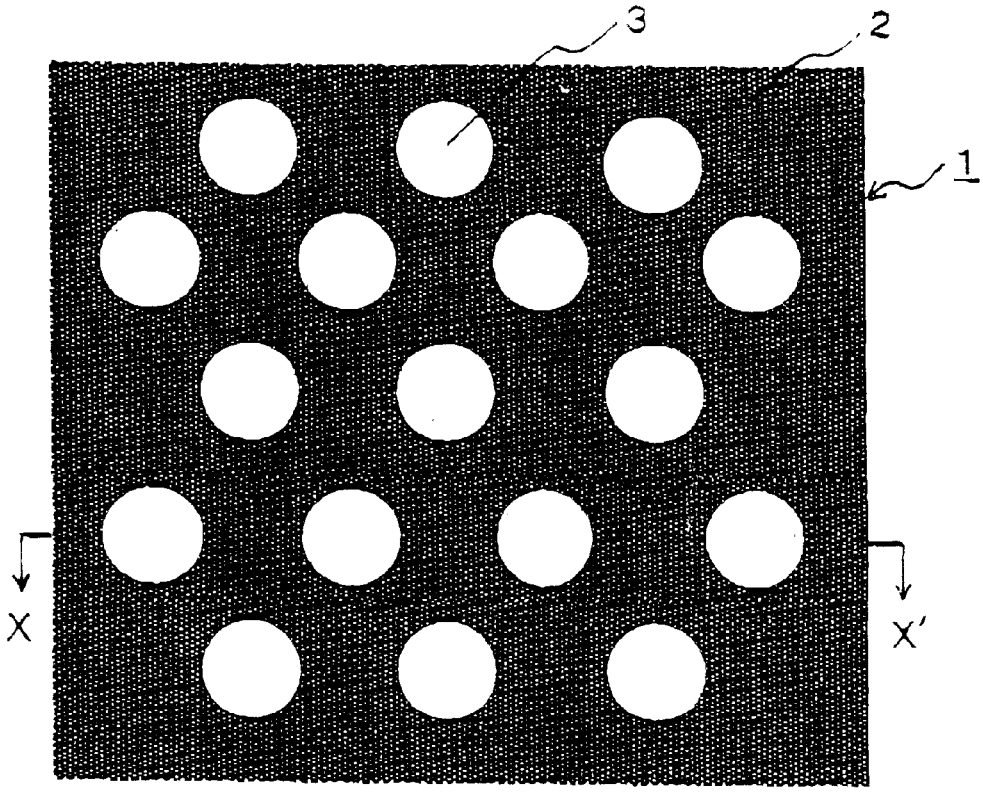
FIG. 1 is a schematic view showing a part of a abrading surface of an abrading disc of the present invention.
Figure 2:
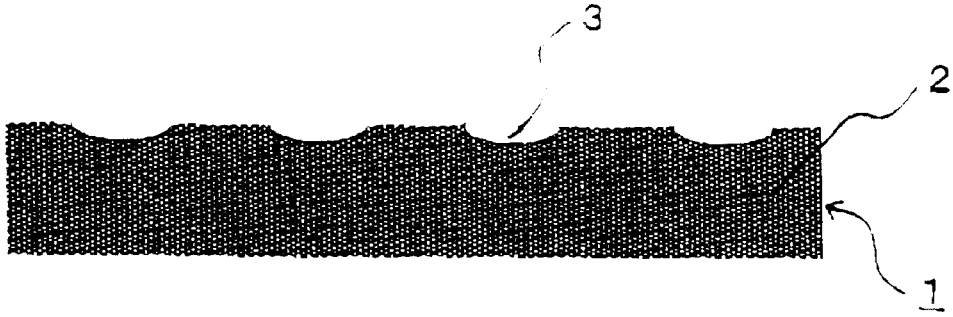
FIG. 2 is a cross-sectional view, taken on line X–X' in FIG. 1, of the abrading disc.

As shown in FIG. 1 and FIG. 2, the abrasive molding 1 has an abrasive area 2 to be placed in frictional contact with an article to be abraded, and a non-abrasive area 3 on a abrading surface of the abrasive molding. Non-abrasive area 3 is interspersed as islands in the abrading surface of abrasive molding 1 in an embodiment illustrated in FIG. 1 and FIG. 2. Alternatively, the non-abrasive area may form a single area like the abrasive area 2. The abrasive area 2 forms a single area in an embodiment illustrated in FIG. 1 and FIG. 2, but, may interspersing as islands like the non-abrasive area 3 illustrated in these figures.

It is preferable that the non-abrasive area is uniformly distributed over a certain region of the abrading surface for achieving uniform abrading. The uniform distribution of the non-abrasive area should preferably be kept during abrading for achieving uniform abrading. The distribution of the non-abrasive area in the abrading surface can be confirmed by observing the surface of the abrasive molding, cut along a plane normal to the abrading surface, by a scanning electron microscope.

The non-abrasive area 3 forms dents which are not brought in frictional contact with the material to be abraded. The non-abrasive area has a function of keeping an abrading liquid containing a loose abrasive grain therein and allowing the abrading liquid to flow between the abrading surface of abrasive molding and the material surface to be abraded, and feeding the abrading liquid onto the abrasive area 2. The abrasive area 2 is the area which is placed in frictional contact with the material to be abraded and which is other than the depressed non-abrasive area 3 on the abrading surface. The abrasive area and the non-abrasive area can be determined by observing the abrading surface of an abrading molding by a scanning electron microscope, and calculating particle diameters and pore diameters by the interceptive method.

The abrasive area has exposed pores having a diameter of not larger than 1 μm and occupying below 15% of the total area of abrasive area. The lower limit of the area of pores having a diameter of not larger than 1 μm is not particularly limited. Even when this area is 0%, namely, the abrasive area is extremely densified to an extent such that no exposed pore is found, abrading can efficiently be carried out. In contrast, if this ratio exceeds 15%, the rate of abrasion can be high in some cases, but, when a loose abrasive grain having a conventionally employed size is used, the abrasive molding is liable to be undesirably abraded to a significant degree.

The non-abrasive area occupies 20% to 60% of the abrading surface, i.e., the sum of the abrasive area and the non-abrasive area. If the ratio of the non-abrasive area is too small, the rate of abrasion is reduced and the efficiency of abrading is reduced. In contrast, the ratio of the non-abrasive area is too large, the rate of abrasion can be kept high but the abrasive molding is abraded to an undesirable extent.

The pores in the non-abrasive area preferably have a diameter such that at least 20% of the pores have a diameter of at least 10 μm to enhance the rate of abrading and reduce the abrading of the abrasive molding. The upper limit thereof is not particularly limited, but, when pores having a diameter exceeding 3 mm are present in a large amount, the abrasive molding tends to be damaged during abrading. Therefore, at least 80% of the pores having a diameter at least 10 μm preferably fall within the range of in the range of 10 μm to 3 mm.

Usually an abrading liquid containing a loose abrasive grain having an average particle diameter not larger than 10 μm is used for abrading by using the abrasive molding of the present invention. Therefore, at least 60% of the inorganic particles exposed on the abrasive area of the abrading surface preferably have a diameter of not larger than 5 μm. In other words, the ratio of the inorganic particles having a diameter exceeding 5 μm in the abrasive area is preferably smaller than 40%. If the ratio of the inorganic particles having a diameter exceeding 5 μm in the abrasive area is at least 40%, the rate of abrasion becomes drastically reduced when the abrading is continued for a long period of time.

In view of the fact that a loose abrasive grain having an average particle diameter not larger than 10 μm is usually used for abrading, the pores in the non-abrasive area preferably have a diameter such that 20% to 80% of the pores have a diameter of 1 μm to 10 μm to minimize the abrasion of the abrasive molding during abrading. If the pores having a diameter of 1 μm to 10 μm are larger than 80%, the abrasion efficiency is not satisfactory but the abrasion of the abrasive molding becomes undesirably large. If the pores having a diameter of 1 μm to 10 μm are smaller than 80%, the rate of abrasion is reduced when abrading is continued for a long period of time.

To avoid the deterioration of the abrasive molding during abrading step, especially lapping step, the abrasive molding of the present invention is preferably made substantially from a powdery inorganic material having a hardness of at least 800 kg/mm$^2$. By the term "substantially" herein used is meant that the abrasive molding of the present invention is made from a powdery inorganic material, at least 90% by weight of which has a hardness of at least 800 kg/mm$^2$. The substance of the powdery inorganic material having the above-specified hardness is not particularly limited, and includes, for example, aluminum oxide, zirconium oxide stabilized with a stabilizer such as yttrium oxide or cerium oxide, and silicon carbide.

By the hardness of a powdery inorganic material herein used we mean the Vickers hardness as determined as follows. A powdery inorganic material having an average primary particle diameter in the range of 0.1 to 5 μm is cast molded or press molded into a shaped body. The shaped is sintered to give a sintered body having a relative density of at least 95%. The Vickers hardness of the sintered body is measured according to JIS R-1610 under a load of 10 kg at a load-retention time of 10 seconds.

The substance of the powdery inorganic material having the above-specified hardness is not particularly limited, and includes, for example, aluminum oxide, zirconium oxide stabilized with a stabilizer such as yttrium oxide or cerium oxide, and silicon carbide.

The material of inorganic particles constituting the abrading disc is appropriately chosen depending upon the particular adaptability to a material to be abraded. By the term "adaptability to a material to be abraded" herein used we mean physical properties such as hardness and toughness of the material to be abraded, and the chemical properties such as chemical reactivity thereof, and the properties required for the abraded material such as surface precision and flatness, and the rate of abrasion.

As specific examples of the material of inorganic particles, there can be mentioned oxides such as aluminum oxide, silicon oxide, cerium oxide, zirconium oxide, stabilizer-containing zirconium oxide, manganese oxide, titanium oxide, magnesium oxide, iron oxide, chromium oxide and yttrium oxide; and non-oxides such as silicon carbide, boron carbide and boron nitrides. These inorganic particles may be used either alone or in combination.

Of these, inorganic particles consisting essentially of alumina particles and stabilizer-containing zirconia particles are preferable. The stabilizer-containing zirconia contains a stabilizer such as oxides of rare earth elements such as yttrium oxide, scandium oxide, indium oxide and cerium oxide, and magnesium oxide and calcium oxide. Alumina and a stabilizer-containing zirconia are beneficial in that, in addition to good abrasive properties, these materials and their raw materials have good handling property, and the production thereof is not complicated and the production cost is relatively low.

In the preferable abrasive molding comprising inorganic particles consisting essentially of alumina and a stabilizer-containing zirconia, it is more preferable that at least 60% of the total of alumina particles and stabilizer-containing zirconia particles have a diameter of not larger than 5 $\mu$m. More preferably, at least 60% of the alumina particles have a diameter of not larger than 5 $\mu$m and at least 60% of the stabilizer-containing zirconia particles have a diameter of not larger than 5 $\mu$m. In the case where the abrasive area of the abrading surface of the abrasive molding consists essentially of such alumina particles and such stabilizer-containing zirconia particles, when abrading is continued for a long period of time while an abrading liquid containing a loose abrasive grain having an average particle diameter of not larger than 10 $\mu$m is used, the reduction of abrading rate can be minimized and abrading can be carried out under stable conditions.

Preferably, to minimize the abrasion of the abrasive molding, the total area (X) of the alumina particles exposed on the abrading surface of the abrasive molding and the total area (Y) of the stabilizer-containing zirconia particles exposed on the abrading surface thereof satisfy the formula:

$$0.25 \leqq X/(X+Y) \leqq 0.95.$$

More preferably the formula $0.4 \leqq X/(X+Y) \leqq 0.9$ is satisfied.

Crystal structure of the stabilizer-containing zirconia particles may be any of monoclinic system, tetragonal system and cubic system, but, the stabilizer-containing zirconia particles preferably have a monoclinic crystal percentage of not larger than 5% in view of reduced abrasion of the abrasive molding. The ratio of the crystal phases is determined by measuring diffraction integrated intensity on faces of the respective crystal systems by X-ray diffractometry.

The stabilizer contained in the stabilizer-containing zirconia includes, for example, oxides of a rare earth element such as yttrium oxide, scandium oxide, indium oxide and cerium oxide, and magnesium oxide and calcium oxide. Of these, yttria is especially preferable because it is excellent in mechanical strength such as bending strength and hardness. The amount of yttria is preferably in the range of 3% to 8% by weight based on the sum of the weight of zirconia and the weight of yttria. When the proportion of yttria is too small, the crystal structure becomes unstable and the monoclinic percentage of the abrading surface of the abrasive molding increases. In contrast, the proportion of yttria is too large, the crystal structure becomes stable and tetragonal system and cubic system are obtained, but, the mechanical strength such as bending strength and hardness is reduced and the abrasive molding tends to be abraded.

Process for Producing Abrasive Molding

The process for producing the abrasive molding of the present invention is not particularly limited, and various processes can be employed wherein a powdery inorganic material capable of producing the above-mentioned abrasive molding is molded under pressure and then, if desired, the molded product is sintered or fired or subjected to other treatment.

The particle diameter of a powdery raw material is not particularly limited, but an average particle diameter in the range of 0.005 $\mu$m to 10 $\mu$m is preferable. A raw material with too small diameter is difficult to prepare, and a raw material with too large diameter is apt to cause problems in the production process of the abrasive molding. When powdery alumina and powdery stabilizer-containing yttria are used to produce an abrasive molding consisting essentially of alumina particles and stabilizer-containing particles, the respective powdery materials are preferably separately prepared.

The molding under pressure of the powdery inorganic material includes, for example, press molding of a powdery inorganic material, carried out under conventional pressure conditions, and cast molding, injection molding and extrusion molding.

The powdery inorganic material may be subjected to a pretreatment for enhancing the moldability of the material. As examples of the pretreatment procedure, there can be mentioned a compacting procedure wherein the powdery inorganic material is compacted under various conditions, a pelletizing procedure wherein the powdery inorganic material is dissolved or dispersed in an aqueous medium and the thus-obtained aqueous solution or dispersion is pelletized by spray drying or rolling, an organic material-Incorporating procedure wherein an organic material such as a binder is incorporated in the powdery inorganic material, and a wetting procedure wherein water is added to the inorganic material.

In the organic material-incorporating procedure, the inorganic material having incorporated therein an organic material such as a binder is preferably subjected to a degreasing treatment after the organic material-incorporated inorganic material is shaped into a molding, but before the final abrasive molding is obtained. For example, the degreasing treatment can be carried out by heating the organic material-incorporated inorganic material in the air atmosphere or in an inert gas atmosphere such as nitrogen, argon or helium under enhanced pressure, normal pressure or reduced pressure. In the wetting procedure, the water-added material is dried after the water-added material is shaped into a molding but before the molding is sintered.

A pore-forming agent may be incorporated in the powdery inorganic material to control the micropore structure of the abrasive molding according to the need. The pore-forming agent includes, for example, a powdery organic material and powdery carbon.

An as-shaped abrasive molding, especially, as-shaped abrasive molding from which a binder has been removed, generally has a poor mechanical strength. Hence, the as-shaped abrasive molding is preferably sintered or fired to enhance the mechanical strength and durability for polishing. Sintering or firing of the as-shaped abrasive molding is carried out under various conditions. Appropriate sintering or firing conditions such as temperature, time, program and atmosphere may suitably be determined.

Thus, an abrasive molding having a mechanical strength enough for withstanding the polishing operation can be made by appropriately employing a procedure including, for example, heat-degreasing, sintering or firing, machining, chemical treatment or physical treatment, or a combination of these treatments.

For keeping the abrading surface of the abrasive molding under the above-specified conditions in the course of abrasion, the following should preferably be considered. The pores intervening among the inorganic particles of the abrasive molding must be uniformly dispersed as observed on a plane perpendicular to the abrading surface. For this purpose, when a pore forming agent is used, the pore forming agent is preferably subjected to particle size regulation or classification. Further, a pore forming agent and a powdery inorganic material must be uniformly mixed together. For this purpose, the powdery raw material is preferably made into granules of the desired size which varies depending upon the specific gravity of the granules, the specific gravity of the pore forming agent and the mixing ratio. Further, organic material particles having a predetermined diameter or a carbon fiber having a predetermined fiber length or a hollow particulate material having predetermined inner diameter and outer diameter can be incorporated. The dimensions of these materials should be determined so that an abrasive molding having the desired microstructure is obtained.

Abrasive Disc

An abrasive disc is made by assembling at least one of the above-mentioned abrasive molding with a supporting auxiliary. The supporting auxiliary used is not particularly limited, and can be made of various materials and can be of various shapes. Suitable material and shape can be appropriately chosen depending upon the particular abrasive disc. The abrasive molding or moldings are fixed to the supporting auxiliary, for example, by an adhering procedure using an adhesive, or a procedure of fitting the abrasive moldings into recesses formed on the supporting auxiliary.

The number of abrasive molding fixed to a supporting auxiliary is not particularly limited, and may be either one or two or more. The number of abrasive molding is preferably at least two for the following reasons, although the invention is not bound thereto. When abrasion is conducted by using an abrasive disc having two or more abrasive moldings fixed to a supporting auxiliary in an arrangement such that an abrading liquid applied is discharged through drainage conduits formed between adjacent abrasive moldings, the rate of abrasion can be enhanced. Further, the abrasive moldings are brought into uniform contact with the entirety of a material to be abraded, and uniform abrasion can be effectively achieved. When an abrasive disc having a single abrasive molding fixed to a supporting auxiliary is used, a conduit for draining an abrading liquid is preferably formed on the polishing surface of the abrasive molding.

The shape of the abrasive molding is not particularly limited, and includes, for example, a columnar pellet having a circular cross-section, a square pillar shaped pellet having a triangular or quadrilateral cross-section, and a columnar pellet having a scallop-shaped cross-section, and hollow columnar pellets such as ring-shaped pellet. The size of the abrasive molding is also not particularly limited and can be appropriately chosen depending upon the supporting auxiliary. Usually the size of the abrasive molding is such that the diameter and side length of these materials are not larger than 5 mm.

The fashion by which abrasive moldings are arranged on a supporting auxiliary for constituting an abrasive disc is not particularly limited. For example, a plurality of small abrasive moldings are combined together to form an integrated moldings which are fitted to a supporting auxiliary, or a plurality of abrasive moldings are embedded in a large circular supporting auxiliary.

When a plurality of abrasive moldings are arranged on a supporting auxiliary, the configuration of abrading surfaces of the arranged abrasive moldings preferably conform to a material surface to be abraded. In this case, a supporting auxiliary having a surface configuration conforming to a material surface to be abraded can be used. For example, when a material surface to be abraded is flat, the abrasive moldings are fitted so that heights of abrading surfaces of the abrasive moldings from the surface of the supporting auxiliary are uniform over the entire abrading surfaces, and thus, the abrading surfaces of the abrasive moldings form a flat abraded surface. When a material surface to be abraded is curved, the abrading surfaces of the arranged abrasive moldings preferably form a similarly curved surface. By such arrangement of abrasive moldings, a material surface to be abraded can be brought into direct and uniform contact with the entire abrading surfaces of the abrasive moldings. Thus, maximum and uniform contact between the abrading surfaces of abrasive moldings and the material surface to be abraded can be obtained.

The shape of abrasive disc can be such that the abrading surfaces of abrasive moldings form a surface conforming to a material surface to be abraded, as mentioned above, and can be any shape of flat sheet, circular disc, ring-shape and column, provided that the abrading surfaces are brought into direct contact with a material surface to be abraded, and the disc has an enough mechanical strength and can abrade the material.

Abrading Process Using Abrasive Disc

The abrading process using the above-mentioned abrasive disc is not particularly limited, and the shape of abrasive disc, abrasion conditions and abrading liquid can be appropriately chosen. When an abrading liquid is used, conventional abrading liquids can be employed, which include, for example, water and neutral, alkaline or acidic aqueous solutions such as an aqueous solution of potassium or sodium and an aqueous solution of an amine or an organic acid, and an organic solution. Conventional loose abrasive grains can be used, which include, for example, oxides such as aluminum oxide, silicon oxide, cerium oxide, zirconium oxide, manganese oxide, titanium oxide, magnesium oxide, iron oxide, chromium oxide, yttrium oxide and tin oxide, and non-oxides such as silicon carbide, boron carbide and boron nitride. The zirconium oxide may be stabilized with a stabilizer including oxides of rare earth element such as yttrium oxide, scandium oxide, indium oxide and cerium oxide, magnesium oxide and calcium oxide.

The abrading liquids are used at a temperature lower than the boiling point thereof. The flow rate of abrading liquid, the abrading pressure, the relative speed between the material to be polished and the abrasive disc (namely, the rate of rotation of the abrasive disc), and other abrading conditions are not particularly limited and can be appropriately chosen.

In the abrading process using the above-mentioned abrasive disc, abrading is effected without use of an abrasive cloth. The abrasive disc used is more durable, i.e., has a longer operable life, than an abrasive cloth. Thus, the frequency of exchange is reduced and the efficiency of abrasion is enhanced, as compared with the conventional abrading process using an abrasive cloth.

The material to be abraded by the abrasive disc of the invention includes, for example, substrate materials such as a semiconductor substrate, an oxide substrate, a glass substrate and silica glass substrate, magnetic head materials, glass materials, metal materials, optical materials such as lens, and building materials such as building stones.

The invention will now be described specifically by the following examples that by no means limit the scope of the invention.

Characteristics of abrasive moldings and abrasive discs were determined by the following method.

(1) Relative Density of Abrasive Molding (%)

A sample of abrasive molding with a flat plate-form having a size of 100 mm×100 mm×15 mm (thickness) was prepared. The sample weight was measured by an electronic force balance and the dimensions thereof were measured by a micrometer. The bulk density W2 was calculated from the weight and dimensions. True density W1 of the abrasive molding was determined according to JIS-R-2205 by pulverizing a part of the sample to determine the true density W1, and the relative density was calculated from the following formula.

$$\text{Relative density } (\%)=(W2/W1)\times 100$$

(2) Microstructure of Abrading Surface of Abrasive Molding

An abrasive molding was embedded in an acrylic resin and cut by a microtome to prepare a sample. The sample was observed by a scanning electron microscope ISI DS-130 available from Akashi Seisakusho K. K., Japan. The average particle diameter was measured on observed particles in consideration of pores and determined by an interceptive method. In this determination, average diameter of particles was calculated from a segment of line traversing each particle, and diameter of a pore was calculated from a segment of line traversing each pore. Based on the sum of diameters of inorganic particles and diameters of pores having a diameter of not larger than 1 μm, the total abrasive area B was calculated. The total non-abrasive area A is calculated by deducting the total non-abrasive area from the area of abrading surface (A+B). Thus, the ratio of the total non-abrasive area A to the sum of A and B is calculated by the formula: ratio of non-abrasive area=A/(A+B).

(3) Average Particle Diameter of Inorganic Particles Constituting Abrasive Molding The abrading surface of an abrasive molding was observed as mentioned in (2) above, and the average particle diameter of inorganic particles constituting the abrasive molding was determined based on the particle number standard by the interceptive method.

(4) Distribution of Particle Diameter in Abrasion Area of Abrasive Molding

From the particle diameter as determined based on the particle number standard by the interceptive method as mentioned in (3) above, particle diameter distribution and average particle diameter were determined on the assumption that the observed particle shapes are round.

(5) Ratio of Pore Area to Abrading Area of Abrasive Molding

The abrading surface of an abrasive molding was observed as mentioned in (2) above, and the total area of inorganic particles were calculated from a segment of line traversing each inorganic particle and the total area of pores having a diameter of not larger than 1 μm were calculated from a segment of line traversing each pore, by the interceptive method. The ratio of the area of pores having a diameter of not larger than 1 μm to the abrasive area was defined by the ratio of the pore area to the sum of the area of the particles and the pore area.

(6) Ratio of Pore Area to Non-abrading Area of Abrasive Molding

The abrading surface of an abrasive molding was observed as mentioned in (2) above, and the total area of pores having a diameter of larger than 1 μm were calculated from a segment of line traversing each pore, by the interceptive method. The total area of pores having a diameter of larger than 1 μm is calculated, and the ratio of said area of pores to the non-abrasive area was calculated.

(7) Percentage of Crystal Phase of Abrasion Surface of Abrasive Molding

X-ray diffraction was carried out using X-ray diffraction apparatus ("MXP-3" available from MacScience Co.) (CuKα ray, 40 kV, 30 mA) to measure diffraction integral intensity of lattice planes of monoclinic, tetragonal and cubic systems of a stabilizer-containing zirconia. The monoclinic percentage is calculated according to the following formula.

$$\text{Monoclinic percentage } (\%)=\{I_M(111)+I_M(111)\}/\{I_M(111)-I_M(111)-I_{T+C}(111)\}\times 100$$

wherein $I_M(111)$: diffraction intensity of plane (111) of monoclinic system of stabilizer-containing zirconia, $I_M(111)$: diffraction intensity of plane (111) of monoclinic system of stabilizer-containing zirconia, $I_{T+C}(111)$: sum of diffraction integral intensities of (111) of tetragonal system and (111) of cubic system (8) Compression Strength Using Shimadzu Autograph IS-10T (available from Shimadz Corporation), compression strength was measured according to JIS-R-1608 on a specimen having a size of 10 mm×10 mm×7 mm (thickness). A load was applied at a cross-head speed of 0.5 mm/min.

(9) Abrasion Loss of Abrasive Molding

After abrading test was carried out, the reduction of thickness of an abrasive molding per unit time was measured. The abrasion loss of abrasive molding was evaluated by the thickness reduction, and expressed by the following two ratings.

Rating ○: Abrasion loss was minor and acceptable

Rating ×: Abrasion loss was large and abrasion molding abrasion molding is of poor practical use.

More specifically, in Examples 14–20 and Comparative Examples 11–15 shown in Tables 11 and 13, the abrasion loss was evaluated by the following formula.

$$\text{Abrasion loss of abrasive molding}=\text{amount of abraded abrasive molding/amount of abraded material}$$

The evaluation results were indicated by a relative value as the value in Comparative Example 12 is taken as 1.0.

(10) Abrading Rate and Stability of Abrading Rate

The abrading rate was determined by measuring the amount (in weight) of the material abraded by abrading, and was expressed in terms of the reduction of thickness (in μm) of the abraded material which is calculated from the amount (in weight) and density of the abraded material.

The stability of abrading rate can be a measure for evaluating whether abrasion performance of an abrasive molding can be kept for a long period of time or not without substantial reduction of abrasion loss and substantial reduction of abrading rate when abrading is continued for a long period of time. The stability of abrading rate was evaluated by the comparison of the initial abrading rate to the reduced abrading rate, and was expressed by the following two ratings.

Rating ○: Reduction of abrading rate is minor and abrasive molding is acceptable Rating ×: Reduction of abrading rate is large and abrasion molding is of poor practical use.

More specifically, in Examples 1–9 and Comparative Examples 1–5 shown in Tables 2 and 4, when the amount of abraded material reached 140 mg/g, if the abrading rate relative to the initial abrading rate was at least 0.7, rating ○ was assigned, and, if the relative abrading rate was not larger than 0.7, rating × was assigned.

(11) Surface Precision

Surface precision of an abraded material was evaluated according to JIS-B-0601 by using a universal shape-determining machine SE-3C (available from Kosaka Kenkyusho, Japan). More specifically the center line average roughness (Ra) and the maximum height (Rmax) were measured at a cut-off value of at least 0.8 mm and a measurement length of 2.5 mm.

(12) Abrasion Ratio

The abrasion ratio of the abraded material was determined by measuring the amount (A: in volume) of an abraded material and the abrasion loss (B: determined in weight and expressed in terms of volume). The abrasion ratio 1s defined by a ratio of A/B. The abrasion ratio was evaluated by the following two ratings.

Rating ○: Abrasion ratio is large and abrasive molding is acceptable

Rating ×: Abrasion ratio is small and abrasion molding is of poor practical use.

Production of Abrasive Moldings

Abrasive moldings used in the examples and comparative examples were produced as follows.

Preparation of Abrasive Moldings

Using powdery raw materials having a composition shown in Table 1, 3, 6, 8, 10, 12 or 14, abrasive moldings were made as follows. Each powdery raw material was incorporated with a poly(vinyl alcohol) powder, a poly(butyl methacrylate) powder, potato starch and/or a paraffin wax as an additive; the thus-mixed powder was press-molded under a pressure of 50 to 3,000 kg/cm$^2$ to form a molding; and the as-made molding was sintered at a temperature of 700 to 1,500° C.

Microstructure of the thus-made abrasive moldings was evaluated. The results are shown in the respective tables.

EXAMPLES 1–6. COMPARATIVE EXAMPLES 1–3

Using abrasive moldings No. 11 to No. 19 having compositions and properties shown in Table 1, abrasion tests were carried out as follows. Abrasive moldings each having a columnar shape with a height of 10 mm and a diameter of 25 mm were prepared. 100 abrasive moldings were fitted to a lower disc with diameter of 300 mm of an abrading apparatus PLANOPOL/PEDEMAX2 available from Struers Co. in a fashion such that abrading surfaces of the 100 abrasive moldings form a flat abrading surface. Quartz having a square form with a size of 45 mm×45 mm was used as a material to be abraded. Quartz was abraded by the abrasive moldlngs-fitted disc at a lower disc revolution of 300 rpm while an abrading liquid was forced to flow at a flow rate of 200 ml/min. The abrading liquid used was an aqueous dispersion (A) containing 10% by weight of alumina emery grains having an average particle diameter of 5.2 $\mu$m.

Abrasion loss of abrasive molding, abrasion ratio of quartz, abrading rate, center line average roughness (Ra) and maximum roughness (Rmax) of the abraded quartz surface are shown in Table 2.

As seen from Table 2, abrasion moldings No. 14–19 of the present invention exhibit acceptable abrasion loss, high abrasion ratio, high abrading rate, and give an abraded surface with high surface precision (center line surface roughness and maximum roughness). In contrast, abrasion molding No. 11 (Comparative Example 1) gives a smooth abraded surface having good surface precision, but abrasion loss of abrasive molding is undesirably large. Abrasion molding No. 12 (Comparative Example 2) gives an abraded surface with poor surface precision. Abrasive molding No. 13 (Comparative Example 3) exhibits high abrading rate, but gives an abraded surface with poor surface precision.

TABLE 1

| Abrasive Molding No. | 11 | 12 | 13 | 14 | 15 | 16 | 17 | 18 | 19 |
|---|---|---|---|---|---|---|---|---|---|
| Powdery raw material | | | | | | | | | |
| Composition of zirconia | | | | | | | | | |
| Zirconium oxide (wt. %) | 94.8 | 94.8 | 94.8 | 94.8 | 94.8 | 94.8 | 94.8 | 94.8 | 94.8 |
| Kind of stabilizer | $Y_2O_3$ | $Y_2O_3$ | $Y_2O_3$ | $Y_2O_3$ | $Y_2O_3$ | $Y_2O_3$ | $Y_2O_3$ | $Y_2O_3$ | $Y_2O_3$ |
| Composition of stabilizer (wt. %) | 5.1 | 5.1 | 5.1 | 5.1 | 5.1 | 5.1 | 5.1 | 5.1 | 5.1 |
| Impurities | | | | | | | | | |
| Moisture (wt. %) | 0.2 | 0.2 | 0.2 | 0.2 | 0.2 | 0.2 | 0.2 | 0.2 | 0.2 |
| Ignition loss (wt. %) | 0.1 | 0.1 | 0.1 | 0.1 | 0.1 | 0.1 | 0.1 | 0.1 | 0.1 |
| Abrasive molding | | | | | | | | | |
| Relative density (%) | 99 | 55 | 47 | 79 | 67 | 62 | 67 | 68 | 72 |
| Average particle diameter ($\mu$m) | 0.47 | 0.41 | 0.20 | 0.45 | 0.43 | 0.38 | 0.46 | 0.52 | 0.48 |
| % of pores in abrasive areas (%) | 0.1 | 0.1 | 29.0 | 0.1 | 0.1 | 4.0 | 0.1 | 0.1 | 0.1 |
| A/(A + B) (%) | 2 | 66 | 41 | 26 | 44 | 45 | 43 | 46 | 38 |
| % of pores with diameter ≧ 10 $\mu$m in non-abrasive areas (%) | 0.2 | 88 | 68 | 58 | 70 | 57 | 92 | 94 | 55 |
| Compression strength (kg/cm$^2$) | ≧500 | ≧500 | ≧500 | ≧500 | ≧500 | ≧500 | ≧500 | ≧500 | ≧500 |

TABLE 2

| | Example | | | | | | Com. Ex. | | |
|---|---|---|---|---|---|---|---|---|---|
| | 1 | 2 | 3 | 4 | 5 | 6 | 1 | 2 | 3 |
| Abrasive Molding No. | 14 | 15 | 16 | 17 | 18 | 19 | 11 | 12 | 13 |
| Abrading liquid | A | A | A | A | A | A | A | A | A |
| Evaluation results | | | | | | | | | |
| Abrasion loss of abrasive molding | ○ | ○ | ○ | ○ | ○ | ○ | ○ | × | × |
| Abrasion ratio | ○ | ○ | ○ | ○ | ○ | ○ | ○ | × | × |
| Abrading rate (μm/min) | 5.5 | 5.8 | 6.1 | 7.0 | 6.9 | 7.3 | 2.2 | 1.8 | 5.4 |
| Center line average roughness (μm) | 0.132 | 0.140 | 0.142 | 0.139 | 0.140 | 0.141 | 0.108 | 0.142 | 0.141 |
| Maximum roughness (μm) | 1.3 | 1.6 | 1.6 | 1.6 | 1.6 | 1.6 | 1.1 | 1.7 | 1.7 |

EXAMPLES 7–9. COMPARATIVE EXAMPLES 4, 5

Using abrasive moldings No. 31 to No. 35 having compositions and properties shown in Table 3, abrasion tests were carried out by the same procedures as described in Example 1 wherein an aqueous dispersion (B) containing 5% by weight of alumina emery grains having an average particle diameter of 3.0 μm with all other conditions remaining the same.

The test results are shown in Table 4. As seen from Table 4, abrasion moldings No. 33–35 of the present invention exhibit acceptable abrasion loss, high abrasion ratio and high abrading rate. In contrast, abrasion molding No. 31 (Comparative Example 4) gives a smooth abraded surface, but abrasion loss of abrasive molding is undesirably large. Abrasion molding No. 32 (Comparative Example 5) gives an abraded surface with poor surface precision.

TABLE 3

| Abrasive Molding No. | 31 | 32 | 33 | 34 | 35 |
|---|---|---|---|---|---|
| Powdery raw material | | | | | |
| Composition of alumina | | | | | |
| aluminum oxide (wt. %) | 96.0 | 96.0 | 96.0 | 96.0 | 99.7 |
| Impurities | | | | | |
| Moisture (wt. %) | 0.08 | 0.08 | 0.08 | 0.08 | 0.2 |
| Ignition loss (wt. %) | 0.07 | 0.07 | 0.07 | 0.07 | 01 |
| Abrasive molding | | | | | |
| Relative density (%) | 74 | 95 | 60 | 59 | 58 |
| Average particle diameter (μm) | 2.3 | 2.1 | 1.8 | 1.9 | 0.8 |
| % of pores in abrasive areas (%) | 25.8 | 4.9 | 4.5 | 4.7 | 3.8 |
| A/(A + B) (%) | 4 | 2 | 52 | 43 | 28 |
| % of pores with diameter ≧ 10 μm in non-abrasive areas (%) | 0.2 | 0.2 | 70 | 91 | 66 |
| Compression strength (kg/cm$^2$) | ≧500 | ≧500 | ≧500 | ≧500 | ≧500 |

TABLE 4

| | Example | | | Com. Ex. | |
|---|---|---|---|---|---|
| | 7 | 8 | 9 | 4 | 5 |
| Abrasive Molding No. | 33 | 34 | 35 | 31 | 32 |
| Abrading liquid | B | B | B | B | B |
| Evaluation results | | | | | |
| Abrasion loss of abrasive molding | ○ | ○ | ○ | × | ○ |
| Abrasion ratio | ○ | ○ | ○ | × | ○ |
| Abrading rate (μm/min) | 6.5 | 9.8 | 5.8 | 8.1 | 2.2 |

TABLE 4-continued

| | Example | | | Com. Ex. | |
|---|---|---|---|---|---|
| | 7 | 8 | 9 | 4 | 5 |
| Center line average roughness (μm) | 0.117 | 0.138 | 0.126 | 0.127 | 0.085 |
| Maximum roughness (μm) | 1.4 | 1.6 | 1.2 | 1.3 | 1.1 |

COMPARATIVE EXAMPLES 6, 7

As abrasive molding, a commercially available graphitized cast iron disc having a 300 mm was used. The graphitized cast iron disc was fitted to a lower disc with diameter of 300 mm of the same abrading apparatus as used in Example 1, and an abrading surface of the cast iron was rendered flat. Abrasion tests were carried out by using the graphitized cast iron disc-fitted abrading apparatus and by the same procedures as described in Example 1 wherein an aqueous dispersion (C) containing 30% by weight of alumina emery grains having an average particle diameter of 9.4 μm (Comparative Example 6) and an aqueous dispersion (D) containing 30% by weight of alumina emery grains having an average particle diameter of 23 μm (Comparative Example 7) were used. All other conditions remained the same.

The test results are shown in Table 5.

TABLE 5

| | Com. Ex. | |
|---|---|---|
| | 6 | 7 |
| Abrasive Molding No. | — | — |
| Abrading liquid | C | D |
| Evaluation results | | |
| Abrading rate (μm/min) | 3.7 | 6.2 |
| Center line average roughness (μm) | 0.111 | 0.221 |
| Maximum roughness (μm) | 1.8 | 3.7 |

As seen from comparison of Examples (Ex.) 1–9 with Comparative Examples (Com. Ex.) 6 and 7 using a conventional abrasive molding, when the conventional abrasive molding is used, if it is intended to obtain an abrading surface with good surface precision, then the abrading rate is reduced (Con. Ex. 6); and, if the abrading rate is enhanced, then the surface precision of the abraded surface becomes inferior (Com. Ex. 7). Contrast, in Ex. 1–9, both of abrading rate and surface precision of abraded surface can be enhanced and well-balanced.

Abrading rates in Ex, 1–6 are higher than those in Com. Ex. 1 and 2. Abrading rates in Ex. 7–9 are higher than those in Com. Ex. 5. Com. Ex. 3 shows high abrading rate, but the abrasion loss is very large as compared with Ex. 1–6. Com. Ex. 4 shows high abrading rate, but the abrasion loss is very large as compared with Ex. 7–9.

EXAMPLES 10–13. COMPARATIVE EXAMPLES 8–10

Using abrasive moldings No. 61 to No. 83 having compositions and properties shown in Tables 6 and 8, abrasion tests were carried out by substantially the same procedures as described in Example 1. Before the measurement of stability of abrading rate, abrading rate was measured by using an abrasion liquid (E) shown below.

Abrasion liquid E: an aqueous dispersion containing 10% by weight of alumina emery grains having an average particle diameter of 7.0 μm.

While an abrasion liquid was exchanged per batch, the measurement of abrading rate was repeated. Thereafter measurement of stability of abrading rate was commenced at the time the abrading rate became stabilized. In this measurement, the abrading rate at the commencement of measurement was the initial abrading rate. The measured stability of abrading rate is shown in Tables 7 and 9. The other characteristics were also evaluated. The results are shown in Tables 7 and 9.

TABLE 6

| Abrasive Molding No. | 61 | 62 | 63 | 64 |
|---|---|---|---|---|
| Powdery raw material | | | | |
| Composition of zirconia | | | | |
| Zirconium oxide (wt. %) | 94.8 | — | — | — |
| Kind of stabilizer | $Y_2O_3$ | — | — | — |
| Composition of stabilizer (wt. %) | 5.1 | — | — | — |
| Composition of alumina | | | | |
| aluminum oxide (wt. %) | — | 96.0 | 99.7 | 99.7 |
| Impurities | | | | |
| Moisture (wt. %) | 0.2 | 0.08 | 0.2 | 0.2 |
| Ignition loss (wt. %) | 0.1 | 0.07 | 0.1 | 0.1 |
| Abrasive molding | | | | |
| Relative density (%) | 65 | 61 | 56 | 59 |
| Average particle diameter (based on particle number) (μm) | 1.03 | 3.49 | 1.46 | 6.78 |
| Average particle diameter (based on area) (μm) | 1.28 | 4.58 | 1.92 | 9.19 |
| % of particle ≦ 5 μm (%) | 99.7 | 68.0 | 99.4 | 91.2 |
| % of pores in abrasive areas (%) | 0.1 | 3.3 | 2.3 | 0.8 |
| A/(A + B) (%) | 46 | 48 | 53 | 49 |
| % of pores with diameter 1~10 μm in non-abrasive areas (%) | 51 | 28 | 36 | 34 |
| Compression strength (kg/cm$^2$) | ≧500 | ≧500 | ≧500 | ≧500 |

TABLE 7

| | Example | | | Com. Ex. |
|---|---|---|---|---|
| | 10 | 11 | 12 | 8 |
| Abrasive Molding No. | 61 | 62 | 63 | 64 |
| Abrading liquid | E | E | E | E |
| Evaluation results | | | | |
| Abrasion loss of molding | ○ | ○ | ○ | ○ |
| Abrasion ratio | ○ | ○ | ○ | ○ |

TABLE 7-continued

| | Example | | | Com. Ex. |
|---|---|---|---|---|
| | 10 | 11 | 12 | 8 |
| Abrading rate (μm/min) | 5.9 | 7.9 | 8.1 | 8.1 |
| Stability of abrading rate | ○ | ○ | ○ | × |
| Reduction of abrading rate | 0.85 | 0.71 | 0.82 | 0.38 |

TABLE 8

| Abrasive Molding No. | 81 | 82 | 83 |
|---|---|---|---|
| Powdery raw material | | | |
| Composition of zirconia | | | |
| Zirconium oxide (wt. %) | 94.8 | 94.8 | 94.8 |
| Kind of stabilizer | $Y_2O_3$ | $Y_2O_3$ | $Y_2O_3$ |
| Composition of stabilizer (wt. %) | 5.1 | 5.1 | 5.1 |
| Composition of alumina | | | |
| aluminum oxide (wt. %) | — | — | — |
| Impurities | | | |
| Moisture (wt. %) | 0.2 | 0.2 | 0.2 |
| Ignition loss (wt. %) | 0.1 | 0.1 | 0.1 |
| Abrasive molding | | | |
| Relative density (%) | 67 | 65 | 72 |
| Average particle diameter (based on particle number) (μm) | 1.08 | 1.03 | 1.13 |
| Average particle diameter (based on area) (μm) | 1.33 | 1.28 | 1.37 |
| % of particle ≦ 5 μm (%) | 99.7 | 99.7 | 99.7 |
| % of pores in abrasive areas (%) | 0.1 | 0.1 | 0.1 |
| A/(A + B) (%) | 44 | 46 | 42 |
| % of pore with diameter of 1–10 μm in non-abrasive areas (%) | 42 | 13 | 94 |
| Compression strength (kg/cm$^2$) | ≧500 | ≧500 | ≧500 |

TABLE 9

| | Example | Com. Ex. | |
|---|---|---|---|
| | 13 | 9 | 10 |
| Abrasive Molding No. | 81 | 82 | 83 |
| Abrading liquid | E | E | E |
| Evaluation results | | | |
| Abrasion loss of molding | ○ | ○ | Δ |
| Abrasion ratio | ○ | ○ | Δ |
| Abrading rate (μm/min) | 6.1 | 5.9 | 6.3 |
| Stability of abrading rate | ○ | ○ | ○ |
| Reduction of abrading rate | 0.91 | 0.85 | 0.84 |

EXAMPLES 14–22. COMPARATIVE EXAMPLES 11–17

Using abrasive moldings No. 101 to No. 144 having compositions and properties shown in Tables 10, 12 and 13, abrasion tests were carried out by substantially the same procedures as described in Example 1. Before the measurement of abrasion loss of abrading moldings, abrading rate was measured by using an abrasion liquid shown below.

The abrading liquid used was an aqueous solution containing 10% by weight of alumina grains having an average particle diameter about 3 times of that inorganic particles constituting the abrasive molding.

While an abrasion liquid was exchanged per batch, the measurement of abrading rate was repeated. Thereafter measurement of abrasion loss of abrasive moldings were commenced at the time the abrading rate became stabilized. The measured abrasion loss of abrasive moldings is shown in Tables 11, 12 and 13.

TABLE 10

| Abrasive Molding No. | 101 | 102 | 103 | 104 | 105 | 106 | 107 | 108 | 109 |
|---|---|---|---|---|---|---|---|---|---|
| Powdery raw material | | | | | | | | | |
| Composition of alumina | | | | | | | | | |
| aluminum oxide (wt. %) | 93.0 | 85.7 | 69.4 | 48.5 | 27.5 | 69.4 | 96.4 | 99.8 | — |
| Composition of zirconia | | | | | | | | | |
| Zirconium oxide (wt. %) | 6.5 | 13.5 | 28.9 | 48.8 | 68.7 | 25.8 | 3.2 | — | 94.8 |
| Kind of stabilizer | $Y_2O_3$ | $Y_2O_3$ | $Y_2O_3$ | $Y_2O_3$ | $Y_2O_3$ | $CeO_2$ | $Y_2O_3$ | — | $Y_2O_3$ |
| Composition of stabilizer (wt. %) | 0.4 | 0.7 | 1.6 | 2.6 | 3.7 | 4.7 | 0.2 | — | 5.1 |
| Impurities | | | | | | | | | |
| Moisture (wt. %) | 0.1 | 0.1 | 0.1 | 0.2 | 0.2 | 0.1 | 0.1 | 0.1 | 0.2 |
| Ignition Loss (wt. %) | 0.1 | 0.1 | 0.1 | 0.1 | 0.1 | 0.1 | 0.1 | 0.1 | 0.1 |
| Abrasive molding | | | | | | | | | |
| Relative density (%) | 63 | 62 | 62 | 63 | 64 | 65 | 64 | 61 | 67 |
| % of pores in abrasive areas (%) | 1.5 | 3.6 | 3.6 | 2.9 | 2.4 | 3.3 | 1.2 | 1.9 | 0.1 |
| ratio of non-abrasive area (%) | 0.47 | 0.46 | 0.46 | 0.45 | 0.44 | 0.45 | 0.47 | 0.47 | 0.44 |
| Av. diameter of whole particles ($\mu$m) | 1.81 | 1.17 | 1.08 | 0.96 | 0.84 | 1.10 | 2.09 | 1.46 | 1.03 |
| Av. diameter of compn of alumina ($\mu$m) | 1.89 | 1.24 | 1.21 | 1.14 | 1.05 | 1.23 | 2.14 | 1.46 | — |
| Av. diameter of compn of zirconia ($\mu$m) | 0.73 | 0.75 | 0.77 | 0.78 | 0.78 | 0.80 | 0.73 | — | 1.03 |
| Ratio of particles ≦ 5 $\mu$m (whole) (%) | 99.4 | 99.5 | 99.5 | 99.6 | 99.5 | 99.5 | 99.4 | 99.4 | 99.7 |
| Ratio of particles ≦ 5 $\mu$m (alumina) (%) | 99.4 | 99.4 | 99.5 | 99.6 | 99.6 | 99.5 | 99.4 | 99.4 | — |
| Ratio of particles ≦ 5 $\mu$m (zirconia) (%) | 99.8 | 99.8 | 99.6 | 99.6 | 99.4 | 99.6 | 99.8 | — | 99.7 |
| Area ratio of alumina X/(X + Y) | 0.93 | 0.86 | 0.70 | 0.49 | 0.28 | 0.69 | 0.97 | 1 | 0 |
| Compression strength (kg/cm$^2$) | ≧500 | ≧500 | ≧500 | ≧500 | ≧500 | ≧500 | ≧500 | ≧500 | ≧500 |

TABLE 11

| | Example | | | | | | Com. Ex. | | |
|---|---|---|---|---|---|---|---|---|---|
| | 14 | 15 | 16 | 17 | 18 | 19 | 11 | 12 | 13 |
| Abrasive Molding No. | 101 | 102 | 103 | 104 | 105 | 106 | 107 | 108 | 109 |
| Evaluation results | | | | | | | | | |
| Abrasion loss of abrasion molding | 0.89 | 0.43 | 0.41 | 0.59 | 0.76 | 0.61 | 0.98 | 1 | 1.59 |

TABLE 12

| | Ex. | Com. Ex. | |
|---|---|---|---|
| Example | 20 | 14 | 15 |
| Abrasive Molding No. | 121 | 122 | 123 |
| Powdery raw material | | | |
| Composition of alumina ingredient aluminum oxide (wt. %) | 85.7 | 85.7 | 69.4 |
| Composition of zirconia ingredient | | | |
| Zirconium oxide (wt. %) | 13.5 | 13.5 | 29.9 |
| Kind of stabilizer | $Y_2O_3$ | $Y_2O_3$ | $Y_2O_3$ |
| Composition of stabilizer (wt. %) | 0.7 | 0.7 | 0.6 |
| Impurities | | | |
| Moisture (wt. %) | 0.1 | 0.1 | 0.1 |
| Ignition loss (wt. %) | 0.1 | 0.1 | 0.1 |
| Abrasive molding | | | |
| Relative density (%) | 62 | 61 | 62 |
| % of pores in abrasive areas (%) | 3.6 | 3.70 | 3.3 |
| Ratio of non-abrasive area (%) | 46 | 47 | 46 |
| Average particle diameter of whole particles (based on particle number) ($\mu$m) | 1.17 | 1.17 | 1.07 |
| Average particle diameter of alumina ingredient (based on particle number) ($\mu$m) | 1.24 | 1.23 | 1.21 |
| Average particle diameter of zirconia ingredient (based on particle number) ($\mu$m) | 0.75 | 0.75 | 0.76 |
| % of particles with diameter ≦5 $\mu$m (whole) (%) | 99.5 | 99.5 | 99.5 |
| % of particles with diameter ≦5 $\mu$m (alumina) (%) | 99.4 | 99.4 | 99.5 |
| % of particles with diameter ≦5 $\mu$m (zirconia) (%) | 99.8 | 99.7 | 99.6 |
| Area ratio of alumina X/(X + Y) | 0.86 | 0.85 | 0.70 |
| Monoclinic % | 0.4 | 5.7 | 38.0 |
| Compression strength (kg/cm$^2$) | ≧500 | ≧500 | ≧500 |
| Evaluation Results | | | |
| Abrasion loss of molding material | 0.43 | 0.69 | 1.33 |

TABLE 13

| | Example | | Com. Ex. | |
|---|---|---|---|---|
| Example | 21 | 22 | 16 | 17 |
| Abrasive Molding No. | 141 | 142 | 143 | 144 |
| Powdery raw material | | | | |
| Composition of alumina | | | | |
| aluminum oxide (wt. %) | 69.4 | 69.4 | 69.4 | 69.4 |

TABLE 13-continued

| | Example | | Com. Ex. | |
|---|---|---|---|---|
| Example | 21 | 22 | 16 | 17 |
| Composition of zirconia | | | | |
| Zirconium oxide (wt. %) | 28.9 | 28.4 | 29.9 | 26.4 |
| Kind of stabilizer | $Y_2O_3$ | $Y_2O_3$ | $Y_2O_3$ | $Y_2O_3$ |
| Composition of stabilizer (wt. %) | 1.6 | 2.1 | 0.6 | 4.1 |
| Impurities | | | | |
| Moisture (wt. %) | 0.1 | 0.1 | 0.1 | 0.1 |
| Ignition loss (wt. %) | 0.1 | 0.1 | 0.1 | 0.1 |
| Abrasive molding | | | | |
| Relative density (%) | 62 | 62 | 62 | 64 |
| % of pores in abrasive areas (%) | 3.6 | 3.5 | 3.3 | 3.1 |
| Ratio of non-abrasive area (%) | 46 | 44 | 46 | 44 |
| Average particle diameter of whol particles (based on particle number) (μm) | 1.08 | 1.10 | 1.07 | 1.11 |
| Average particle diameter of alumina ingredient (based on particle number) (μm) | 1.21 | 1.22 | 1.21 | 1.22 |
| Average particle diameter of zirconia ingredient (based on particle number) (μm) | 0.77 | 0.81 | 0.76 | 0.83 |
| % of particles with diameters ≦5 μm (whole) (%) | 99.5 | 99.5 | 99.5 | 99.5 |
| % of particle with diameter ≦5 μm (alumina) (%) | 99.5 | 99.5 | 99.5 | 99.5 |
| % of particle with diameter ≦5 μm (zirconia) (%) | 99.6 | 99.6 | 99.6 | 99.6 |
| Area ratio of almina X/(X + Y) | 0.70 | 0.71 | 0.70 | 0.72 |
| Monoclinic % | 0.6 | 0.2 | 38.0 | 0.0 |
| Yttria content in zirconia (wt. %) | 5.1 | 7.0 | 2.0 | 13.4 |
| Compression strength (kg/cm$^2$) | ≧500 | ≧500 | ≧500 | ≧500 |
| Evaluation results | | | | |
| Abrasion loss of abrasive molding | 0.41 | 0.66 | 1.33 | 1.26 |

What is claimed is:

1. An abrasive molding composed of a mass of inorganic particles, said mass having pores intervening among the inorganic particles, which molding has an abrasive area to be placed in frictional contact with an article to be abraded, and a non-abrasive area on an abrading surface of the abrasive molding, said abrasive area having exposed pores having a diameter of not larger than 1 μm, the total area of said exposed pores having a diameter of not larger than 1 μm occupying below 15% of the total area of abrasive area, and the non-abrasive area occupying 20% to 60% of the sum of the abrasive area and the non-abrasive area.

2. The abrasive molding according to claim 1, wherein said non-abrasive area having exposed pores, at least 20% of which have a diameter of at least 10 μm.

3. The abrasive molding according to claim 1, wherein at least 60% of the inorganic particles exposed in the abrasive area have a diameter of not larger than 5 μm.

4. The abrasive molding according to claim 3, wherein the inorganic particles consist essentially of alumina particles and stabilizer-containing zirconia particles, wherein at least 60% of the alumina particles have a diameter of not larger than 5 μm and at least 60% of the stabilizer-containing zirconia particles have a diameter of not larger than 5 μm, and the total area (X) of the alumina particles exposed on the abrading surface of the abrasive molding and the total area (Y) of the stabilizer-containing zirconia particles exposed on the abrading surface thereof satisfy the formula:

$$0.25 \leqq X/(X+Y) \leqq 0.95.$$

5. The abrasive molding according to claim 4, wherein at least 20% of the pores exposed in the non-abrasive area have a diameter of at least 10 μm.

6. The abrasive molding according to claim 4, wherein the stabilizer-containing zirconia particles have a monoclinic crystal percentage of not larger than 5%.

7. The abrasive molding according to claim 6, wherein the zirconia particles contain yttria as a stabilizer.

8. The abrasive molding according to claim 7, wherein the content of yttria in the stabilizer-containing zirconia particles is in the range of 3% to 8% by weight based on the weight of the stabilizer-containing zirconia particles.

9. The abrasive molding according to claim 1, which is made substantially from a powdery inorganic material having a hardness of at least 800 kg/mm$^2$.

10. An abrasive molding composed of a mass of inorganic particles, said mass having pores intervening among the inorganic particles, which molding is made substantially from a powdery inorganic material having a hardness of at least 800 kg/mm$^2$ and which molding has an abrasive area to be placed in frictional contact with an article to be abraded, and a non-abrasive area on an abrading surface of the abrasive molding;

said abrasive area having exposed pores having a diameter of not larger than 1 μm, the total area of said exposed pores having a diameter of not larger than 1 μm occupying below 15% of the total area of abrasive area, and the non-abrasive area occupying 20% to 60% of the sum of the abrasive area and the non-abrasive area; and said non-abrasive area having exposed pores, at least 20% of which have a diameter of at least 10 μm.

11. An abrasive molding composed of a mass of inorganic particles, said mass having pores intervening among the inorganic particles, which molding is made substantially from a powdery inorganic material having a hardness of at least 800 kg/mm$^2$ and which molding has an abrasive area to be placed in frictional contact with an article to be abraded, and a non-abrasive area on an abrading surface of the abrasive molding, said abrasive area having exposed pores having a diameter of not larger than 1 μm, the total area of said exposed pores having a diameter of not larger than 1 μm occupying below 15% of the total area of abrasive area; said non-abrasive area having exposed pores, at least 20% of which have a diameter of at least 10 μm; and the non-abrasive area occupying 20% to 60% of the sum of the abrasive area and the non-abrasive area;

said inorganic particles consisting essentially of alumina particles and stabilizer-containing zirconia particles, wherein at least 60% of the alumina particles have a diameter of not larger than 5 μm and at least 60% of the stabilizer-containing zirconia particles have a diameter of not larger than 5 μm, and the total area (X) of the alumina particles exposed on the abrading surface of the abrasive molding and the total area (Y) of the stabilizer-containing zirconia particles exposed on the abrading surface thereof satisfy the formula:

$$0.25 \leqq X/(X+Y) \leqq 0.95;$$

the stabilizer-containing zirconia particles having a monoclinic crystal percentage of not larger than 5% and containing yttria as a stabilizer in an amount of 3% to 8% by weight based on the weight of the stabilizer-containing zirconia particles.

12. An abrasive disc comprising at least one abrasive molding and a supporting auxiliary, said abrasive molding being fixed to the supporting auxiliary;

said abrasive molding being composed of a mass of inorganic particles, said mass having pores intervening among the inorganic particles, which molding has abrasive area to be placed in frictional contact with an article to be abraded, and non-abrasive area on an abrading surface of the abrasive molding, said abrasive area having exposed pores having a diameter of not larger than 1 μm, the total area of said exposed pores having a diameter of not larger than 1 μm occupying below 15% of the total area of abrasive area, and the non-abrasive area occupying 20% to 60% of the sum of the abrasive area and the non-abrasive area.

13. An abrasive disc comprising at least one abrasive molding and a supporting auxiliary, said abrasive molding being fixed to the supporting auxiliary;

said abrasive molding being composed of a mass of inorganic particles, said mass having pores intervening among the inorganic particles, which molding is made substantially from a powdery inorganic material having a hardness of at least 800 kg/mm$^2$ and which molding has an abrasive area to be placed in frictional contact with an article to be abraded, and a non-abrasive area on an abrading surface of the abrasive molding;

said abrasive area having exposed pores having a diameter of not larger than 1 μm, the total area of said exposed pores having a diameter of not larger than 1 μm occupying below 15% of the total area of abrasive area, and the non-abrasive area occupying 20% to 60% of the sum of the abrasive area and the non-abrasive area; and at least 20% of the pores exposed in the non-abrasive area having a diameter of at least 10 μm, and at least 60% of the inorganic particles exposed in the abrasive area having a diameter of not larger than 1 μm.

14. An abrasive disc comprising at least one abrasive molding and a supporting auxiliary, said abrasive molding being fixed to the supporting auxiliary;

said abrasive molding being composed of a mass of inorganic particles, said mass having pores intervening among the inorganic particles, which molding is made substantially from a powdery inorganic material having a hardness of at least 800 kg/mm$^2$ and which molding has an abrasive area to be placed in frictional contact with an article to be abraded, and a non-abrasive area on an abrading surface of the abrasive molding, said abrasive area having exposed pores having a diameter of not larger than 1 μm, the total area of said exposed pores having a diameter of not larger than 1 μm occupying below 15% of the total area of abrasive area; said non-abrasive area having exposed pores, at least 20% of which have a diameter of at least 10 μm; and the non-abrasive area occupying 20% to 60% of the sum of the abrasive area and the non-abrasive area;

said inorganic particles consisting essentially of alumina particles and stabilizer-containing zirconia particles, wherein at least 60% of the alumina particles have a diameter of not larger than 5 μm and at least 60% of the stabilizer-containing zirconia particles have a diameter of not larger than 5 μm, and the total area (X) of the alumina particles exposed on the abrading surface of the abrasive molding and the total area (Y) of the stabilizer-containing zirconia particles exposed on the abrading surface thereof satisfy the formula:

$$0.25 \leq X/(X+Y) \leq 0.95;$$

the stabilizer-containing zirconia particles having a monoclinic crystal percentage of not larger than 5% and containing yttria as a stabilizer in an amount of 3% to 8% by weight based on the weight of the stabilizer-containing zirconia particles.

* * * * *